US005471682A

United States Patent [19]

Robins et al.

[11] Patent Number: 5,471,682

[45] Date of Patent: Dec. 5, 1995

[54] BATTING GLOVE HAVING A RIDGE FOR USE WITH THE UPPER HAND

[76] Inventors: Bert T. Robins, 1085 Hunting Dr.; Michael R. Jetel, 317 W. Hellen, both of Palatine, Ill. 60067

[21] Appl. No.: 200,588

[22] Filed: Feb. 22, 1994

Related U.S. Application Data

[63] Continuation of Ser. No. 972,001, Nov. 5, 1992, abandoned, which is a continuation-in-part of Ser. No. 680,387, Apr. 4, 1991, abandoned.

[51] Int. Cl.[6] ..... A41D 19/00

[52] U.S. Cl. ..... 2/161.1

[58] Field of Search ..... 2/161 A, 16, 20, 2/19, 159, 160, 161.1, 161.2, 161.6

[56] References Cited

U.S. PATENT DOCUMENTS

| | | | |
|---|---|---|---|
| 2,270,882 | 1/1942 | Link | 2/159 |
| 2,302,875 | 11/1942 | Lykins | 2/159 |
| 2,456,678 | 12/1948 | Cole | 2/159 |
| 2,710,970 | 6/1955 | Kennedy | 2/159 |
| 3,581,312 | 6/1971 | Nickels | 2/159 |
| 3,606,614 | 9/1971 | Dimitroff | 2/159 |
| 4,187,557 | 2/1980 | Tombari | 2/19 |
| 4,329,741 | 5/1982 | Bach | 2/161 A |
| 4,461,043 | 7/1984 | Lomedico | 2/21 |
| 4,590,625 | 5/1986 | Keim | 2/161 A |
| 4,700,405 | 10/1987 | Sternberg | 2/19 |
| 5,113,530 | 5/1992 | Smith | 2/161 A X |
| 5,168,578 | 12/1992 | Stanley | 2/19 |
| 5,218,719 | 6/1993 | Johnson | 2/161 A |

FOREIGN PATENT DOCUMENTS

| | | | |
|---|---|---|---|
| 2305947 | 10/1976 | France | 2/16 |

*Primary Examiner*—C. D. Crowder
*Assistant Examiner*—Larry D. Worrell, Jr.
*Attorney, Agent, or Firm*—McAndrews, Held & Malloy, Ltd.

[57] ABSTRACT

A glove for use with the upper or power hand by batters has a raised ridge that is attached to the palm of the upper hand at an angle that is nearly perpendicular to the axis of the arm of the batter when the arm is straight. The raised ridge spaces the bat away from the vee of the thumb, which frees the wrist of the upper hand to have full wrist movement in swinging a bat and which holds a bat in a proper position in the upper hand. The raised ridge is made of leather or plastic suitable for use with batting gloves, rolled over a piece of closed-cell foam rubber or similar material or an air-filled bladder, either sealed or pumped, that supports the ridge and cushions transferred shocks.

8 Claims, 5 Drawing Sheets

BATTING GLOVE HAVING A RIDGE FOR USE WITH THE UPPER HAND

This is a continuation of application Ser. No. 07/972,001 filed Nov. 5, 1992 now abandoned, which is a continuation in part of our application Ser. No. 680,387, filed Apr. 4, 1991, now abandoned.

BACKGROUND OF THE INVENTION

This invention relates to a glove for use with a baseball and softball bat or other similar implement that is used in a two-handed swing by a baseball or softball batter or other such user.

Gloves of one type or another have long been used by baseball and softball batters to improve their grips and also to protect their hands against chafing and against injury from impact. An example of a glove designed for use by a baseball batter is given in U.S. Pat. No. 4,700,405, entitled "Baseball Glove." In the '405 patent, a pair of gloves includes means for linking the fingers together for increased gripping efficiency and also means for increasing the gripping area and for cushioning against shock. In addition, the right-hand glove includes means for adjustably linking the thumb and adjacent fingers to effect further improvement. In this patent, the description is provided in terms of a right-handed batter. Thus, the left hand of the batter, which is closer to the grip end of the bat, is what will be referred to here as the lower hand, and the right hand is what will be referred to here as the upper hand. The '405 patent provides increased gripping surfaces for the upper hand but does not affect the relation of the upper hand to the bat.

U.S. Pat. No. 4,187,557, entitled "Athletic Glove," is a glove for the lower hand of a baseball batter that includes a pad overlying the second phalange of each of the third and fourth fingers of the players to increase the force which the third and fourth fingers can apply to a bat. It is not intended for the upper hand.

An example of a device that has been designed for use by a baseball batter is given in U.S. Pat. No. 4,461,043, listed on a rubber ring sold under the trademark "Direct Protect." This patent teaches a device to be worn to protect the thumb of a batter. A somewhat similar protector for the hand when fielding a baseball is shown in U.S. Pat. No. 4,478,690, listed on a device sold under the trademark "Palm Guard." Neither of the latter two patents teaches a means for keeping a bat in a proper position for use.

The patents referred to above indicate a common feature of most gloves that are currently used to assist batters and other users of swinging implements. This is the fact that they are designed primarily for the lower hand. The lower hand is thought of as the control hand, the one that controls the direction and placement of the fat part of a bat or the like. The upper hand, in contrast, is the power hand, the one that applies most of the power to the bat. Thus, the right hand is the power hand of a right-handed batter because it is typically on the stronger arm. The gripping portion of the lower hand is generally protected by a glove against chafing caused by the turning of the bat or other such swinging implement, and against further chafing and impact injury from the knob at the end of the bat. The gripping portion of the hand is defined here as the palm and the palm sides of the fingers and thumbs. With respect to the upper hand of a batter, the patents that deal with gloves for use with it appear to be concerned more with increasing the power of the grip and of padding the hand against impact and chafing than they are with promoting an improved grip. Gloves for use with both the upper and lower hands of batters also protect the gripping portions of the hands against irritation by pine tar, rosin, or other substances used to improve the grip.

An example of a batting glove that is designed to assist in placement of the bat in the hands of a batter is a glove sold under the name trademark GRIP TEC by Saranac Glove Company, Green Bay, Wis. This glove has areas of a surface that is treated to stay tacky to keep the hands in a position that is once assumed in gripping the bat. It appears that the GRIP TEC glove might assist in maintaining a proper position of a bat once that position is assumed but it would not prevent a user from putting a bat in an improper position.

The object of using a bat or similar swinging implement is to transfer energy from a user to an object such as a ball. The user would normally prefer to move a bat so that it has maximum velocity when it hits the ball. Maximum velocity is achieved most effectively by maximum wrist action of the upper hand. There is comparatively less wrist movement of the lower hand, which guides the bat. Referring especially to a baseball bat, for example, bat speed is generated best when the wrist of the upper hand is free to move. This occurs when the bat lies across the part of the palm that is closer to the bases of the fingers of the upper hand than to the vee of the thumb. A commonly observed improper grip on a bat puts the bat relatively deep in the vee of the thumb, which inhibits wrist movement and also tends to bruise the thumb when the user hits the ball. The vee of the thumb is defined here as the space between the thumb and the edge of the palm of the hand that is closest to the thumb. If a batter holds a bat in the vee of the thumb, the wrist tends to become tense, which restricts the flexibility of the swing and reduces the batter's control of the bat.

The considerations described above are important in a good swing, which is described as getting the fat part of the bat on the ball. This is essentially placing the center of percussion of the bat-batter combination on a line through the center of the ball, transferring maximum energy from the batter and the bat to the ball. A good swing reduces the velocity of the bat on collision with the ball to correspond to the amount of energy transfer to the ball, but does not transfer any of the energy of the bat or ball into torque or axial force on the hands of the batter.

Most swings are not good swings. In baseball or softball, a pitcher puts a considerable amount of effort into trying to make the sweet spot miss the ball by pitching the ball at different speeds and by causing it to curve, rise, drop, or the like. When this happens, part of the energy of the bat, the ball, or both is turned into a torque which transfers an impact to the hands of the batter. More simply, foul tips sting. If, in addition to fouling a pitch, a batter has placed the bat deep in the vee of his thumb, that impact may lead to pain and bruises, in addition to tensing the wrist and inhibiting the swing.

SUMMARY OF THE INVENTION

It is an object of the present invention to provide an improvement in a glove that makes it easier to grip a bat or other swinging implement correctly.

It is a further object of the present invention to provide an improvement in a glove for the upper hand of a batter that places a bat in a location that frees the wrist of the upper hand to transfer force to the implement.

It is a further object of the present invention to provide an improvement in a batting glove for the upper hand that cushions some of the impact resulting from swings that hit a ball improperly.

It is a further object of the present invention to provide an alignment and cushioning device in a batting glove for the upper hand in which the device is an enclosed bladder that is pressurized by a pump.

Other objects will become apparent in the course of detailed description of the invention.

An improvement in a glove for use on the upper or power hand in swinging a two-handed implement such as a bat places a raised ridge across the palm of the glove. The raised ridge is perpendicular or nearly perpendicular to an extended axis of the power arm of a batter, with the angle between the ridge and the extended axis either defined by a line parallel to the ends of the creases between outer fingers or else selected by the user as an angle that provides maximum comfort and ease of use. The ridge causes the user to grip the handle of the bat or the like with the fingers, and keeps the bat from taking a position in the vee of the thumb. This both frees the wrist to apply maximum power to the bat and also prevents the development of bruises in the vee of the thumb. The ridge is preferably made of a substantially cylindrical piece of an elastically deformable material such as closed-cell foam rubber, enclosed in leather or the like and stitched or otherwise affixed to the glove. It is also appropriate to make the ridge from a bladder containing air, either sealed in the bladder or supplied by a pump. The glove is completed by a back portion of nylon, dacron, orlon, or some other natural or synthetic cloth that is preferably knitted to supply elasticity to the glove.

DETAILED DESCRIPTION OF THE INVENTION

Figure 1:
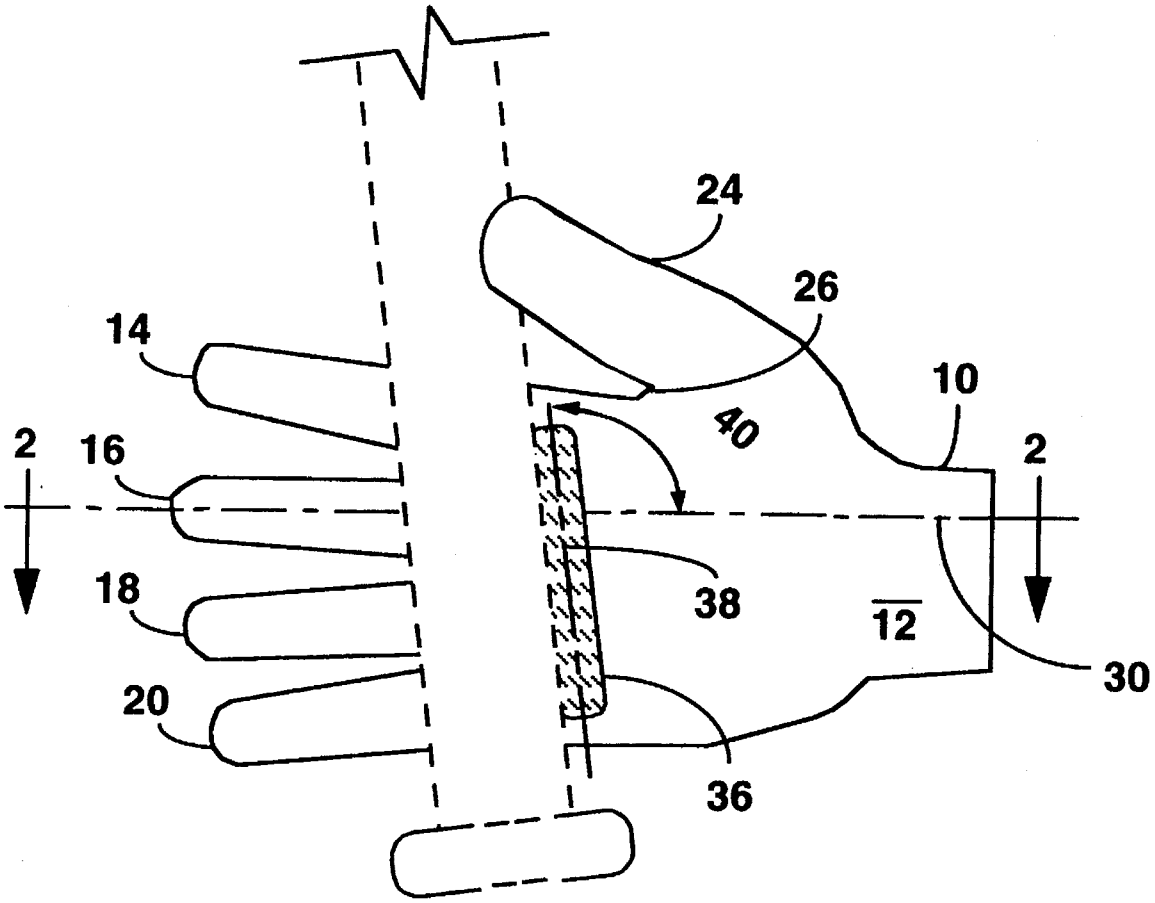
FIG. 1 is a top view of a glove for the practice of the present invention.
Figure 2:
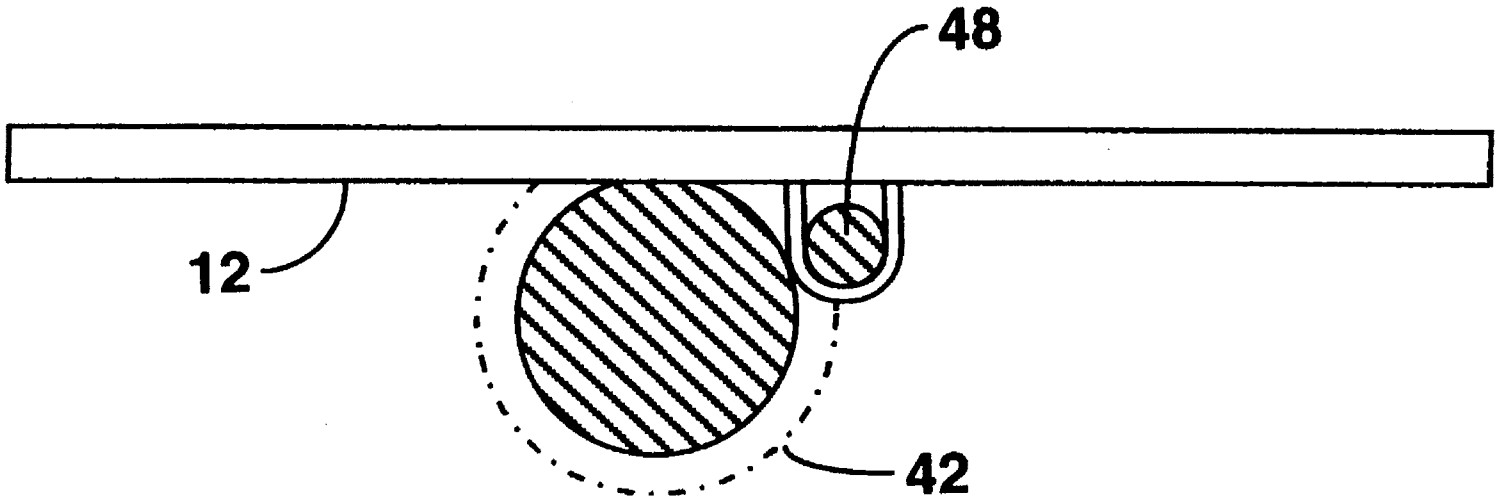
FIG. 2 is a sectional side view of the glove of FIG. 1, taken along section lines 2—2 of FIG. 1.

FIG. 1 is a top view of a glove for the practice of the present invention with a portion of a bat, and FIG. 2 is a sectional side view of the glove of FIG. 1, taken along section lines 2—2 of FIG. 1. In FIGS. 1 and 2, a glove 10 includes a palm 12 and fingers 14, 16, 18, and 20. The fingers 14–20 are extended so as to be essentially straight, as is a thumb 24, which forms a vee 26 together with the edge 28 of the palm 12. The fingers 14–20 and the thumb 24 will be curled about a bat or other swinging implement in use. An axis 30 of the glove 10 is in general an extension of the arm and wrist of a user when the user's wrist is straight. The arm and the user are not shown here, nor is the back of the glove, which is conventionally made of leather or a knitted or woven synthetic or natural cloth material.

The features described above are common to a number of gloves that are used with baseball and softball bats and the like. The present invention adds to these a ridge 36 that is attached to the palm 12. The ridge 36 has a longitudinal axis 38 that makes an angle 40 with respect to the axis 30 of the glove 10. The angle 40 will typically be close to a right angle, and an arbitrary angle near the perpendicular, preferably somewhat more that ninety degrees, can be set in gloves for sale to the public. When an arbitrary angle 40 is chosen it is best defined by a line that is parallel to a line connecting points determined by the intersections of the bases of the fingers 14 and 16 and the fingers 18 and 20 and 1" to 1½" toward the wrist in a batting glove. A serious athlete such as a professional baseball player, who may well exceed 200 swings a day in practice, may prefer to determine by experiment the angle 40 that suits him or her best and have gloves custom-made to that angle 40.

When the ridge 36 is placed to the satisfaction of a user, a bat 42 is placed along the ridge 36, which forms a straight line along the bat 42. This insures that the user grips the bat properly with the upper hand, and it keeps the bat 42 from moving back into the vee 26. In the case of a bat, in addition to keeping the wrists of the user free to have maximum flexibility, the ridge 36 absorbs some of the impact produced by hitting balls away from the sweet spot. That absorption is assisted by making a core 48 of the ridge 36 from a substantially cylindrical piece of a shock-absorbing material such as a closed-cell foam rubber, the cylindrical piece having a diameter of about ½" in a batting glove. Other possible materials include but are not limited to tubing of polyethylene or a similar flexible polymer sealed to trap air, either as a sealed bladder or as a bladder connected to a pump; a solid piece of rubber, neoprene, or the like, and essentially any material that will hold its substantially cylindrical shape under impact and will give enough to absorb some of the impact. The diameter of the core 48 may vary to provide a straight ridge 36 that is satisfactory to a user. The core 48 is held in place by a cover 50 of leather or the like that can be stitched to the palm 12 of the glove 10 to provide a straight surface that contacts a bat. The cover 50 might also be secured by glue or rivets, but stitching is the preferred method of securing it.

Figure 3:
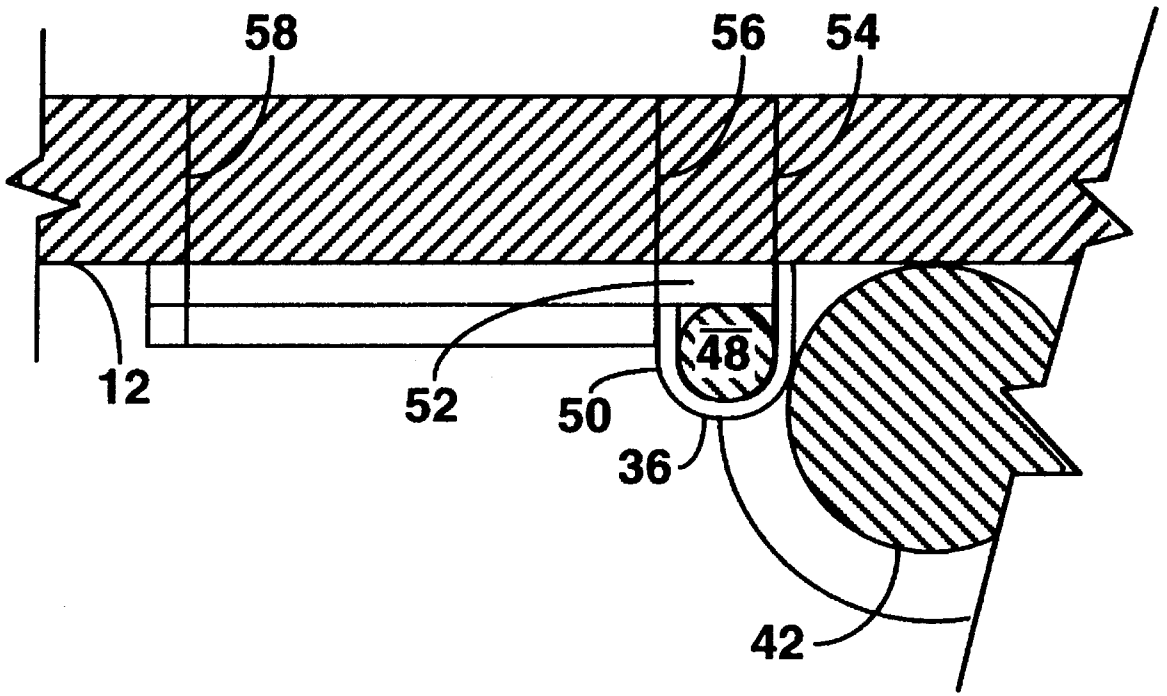
FIG. 3 is an expanded view of a portion of the sectional side view of FIG. 2.
Figure 4:
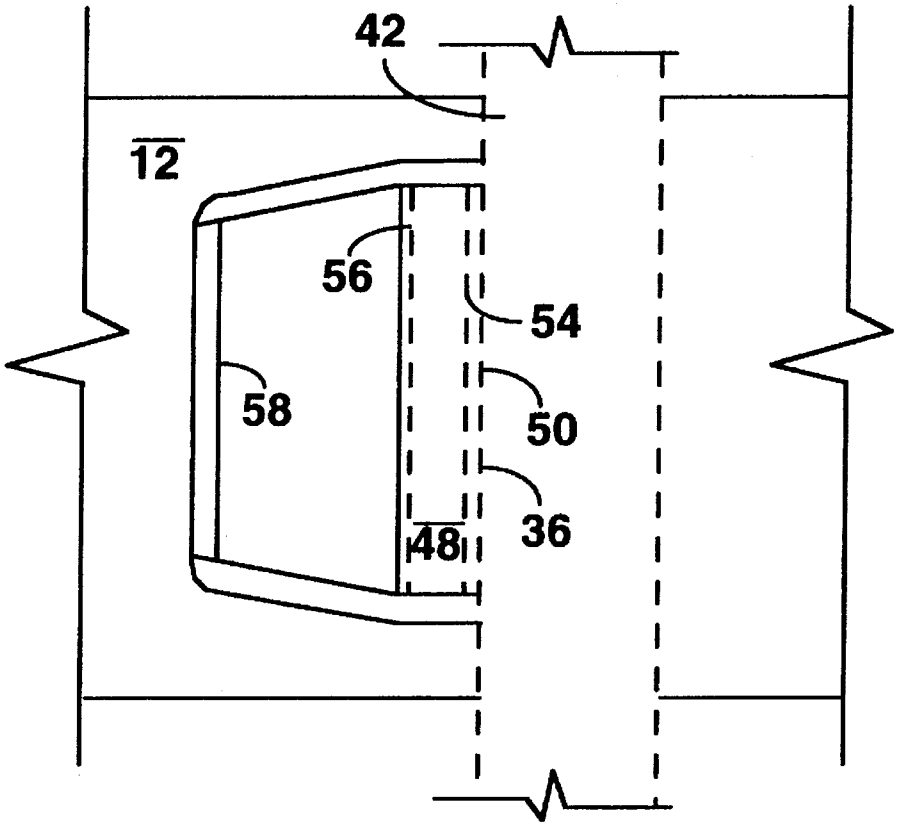
FIG. 4 is a top view of the portion of the glove in FIG. 3.

FIG. 3 is an expanded view of a portion of the sectional side view of FIG. 2, and FIG. 4 is a top view of the portion of the glove in FIG. 3. In FIGS. 3 and 4, the bat 42 is held properly in place against the palm 12 by the ridge 36. In forming the ridge 36, a sheet 52 of leather, an appropriate polymer, or the like is secured to the palm 12 by a line of stitches 54 that defines the placement of the ridge 36 and its line of contact with the bat 42. The core 48 is placed parallel to the line of stitches 54, and the sheet 52 is formed tightly over the core 48 and stitched to the palm 12 by a line of stitches 56. The sheet 50 then forms the cover 50, which is completed by a line of stitches 58 that extends around the outer edge of the sheet 52 to the line of stitches 54.

Figure 6:
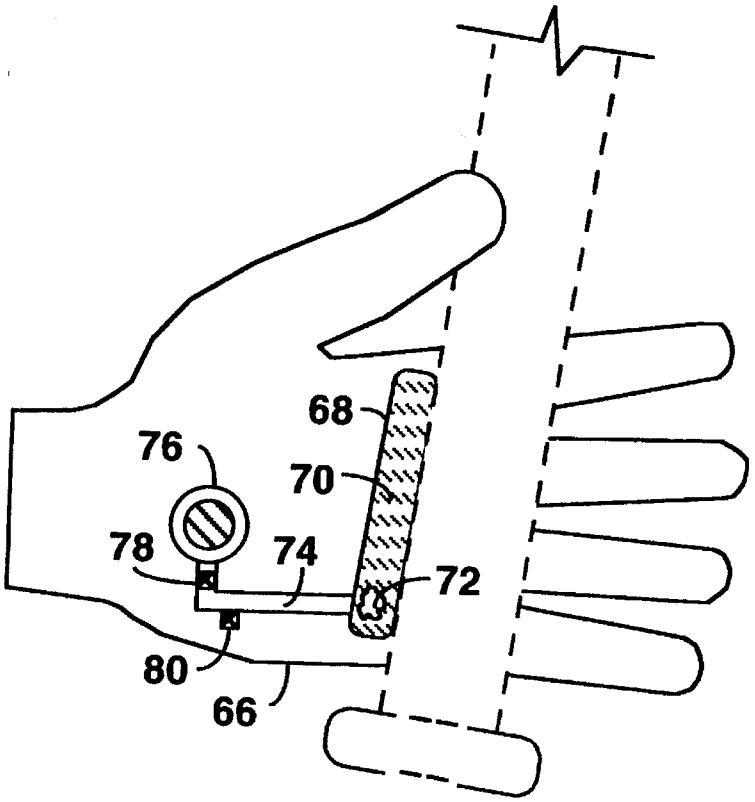
FIG. 6 is a top view of a glove having a sealed bladder with a pump.
Figure 5:
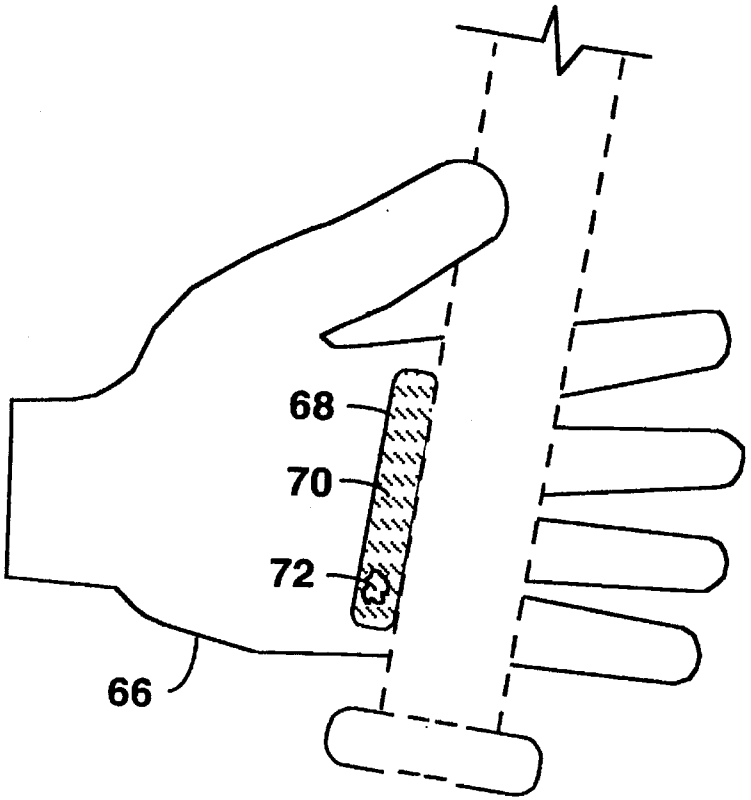
FIG. 5 is a top view of a glove having a sealed bladder.

FIG. 5 is a top view of a glove having a sealed bladder, and FIG. 6 is a top view of a glove having a bladder with a pump. In FIGS. 5 and 6, a glove 66 has a ridge 68 that is formed by stitching a cover 70 over a bladder 72. The bladder 72 is sealed in FIG. 5 and is connected in FIG. 6 to a tube 74 that conveys air to the bladder 72 from a pump 76. A check valve 78 retains air in the tube 74 and the bladder 72 until it is released by operating a vent valve 80. The sealed bladder 72 of FIG. 5 thus has a set amount of firmness while the pumpable bladder 72 of FIG. 6 can be adjusted in firmness by the user to a desired level.

The preceding description is intended to enable one of ordinary skill in the art to make and use the invention, and discloses the best mode known to the inventors for practicing the invention. However, it should be understood that variations are possible in the practice. For example, the core 48 may be made of any material that holds its shape during the normal life of a batting glove and that will compress appropriately to absorb impacts. In addition to the closed-cell rubber and air-filled bladders described above, other materials may be used that function as described. The cover 50 was made of leather in the preferred embodiment, either kid or goatskin, but it should be understood that any material used as the contact or gripping element in a batting glove should be satisfactory for use. Accordingly, the scope of the invention should be limited only by the scope of the appended claims and their equivalents.

We claim:

1. An improvement in a glove for use with an upper hand of a wearer in swinging a bat having a handle portion, the upper hand being attached by a wrist to an arm having an axis, the glove including a palm, a back, an index finger and third finger having a first point determined by the intersection of their bases, a ring finger and small finger having a second point determined by the intersection of their bases, the improvement comprising a raised elongated ridge attached to the palm of the glove, said ridge having a longitudinal axis that is disposed at an angle near a perpendicular to an axis of an arm of a wearer of the glove and displaced from the fingers toward a wrist of the user, the longitudinal axis of the raised ridge substantially parallel to a line connecting the first and second points determined by the intersections of the bases of the fingers, said ridge having a substantially straight finger side disposed generally parallel to said longitudinal axis and facing said fingers of said glove, said ridge being sized and shaped to abut the handle of a bat gripped by the wearer's fingers against and parallel to the finger side of said ridge to fix the position and orientation of the bat in an effective swinging position away from the vee of the thumb.

2. The improvement in the glove of claim 1 wherein the raised ridge is formed of a compressible material enclosed in a cover made of a sheet of material.

3. The improvement in the glove of claim 2 wherein the compressible material is closed-cell foamed rubber.

4. The improvement in the glove of claim 1 wherein the raised ridge is formed of a substantially cylindrical piece of closed-cell foamed rubber wrapped in leather and stitched to the palm of the glove.

5. The improvement in the glove of claim 1 wherein the raised ridge is formed of a substantially cylindrical piece of closed-cell foam rubber enclosed in leather that is stitched to the palm of the glove.

6. The improvement in the glove of claim 1 wherein the raised ridge is formed of a sealed bladder enclosed in leather that is stitched to the palm of the glove.

7. The glove of claim 1 wherein the raised ridge comprises:

a bladder;

a leather cover that is stitched to the palm of the glove to enclose the bladder;

a tube connected to the bladder;

a pump connected to the tube to pump air into the bladder;

a check valve disposed in the tube to hold air in the bladder; and a vent valve disposed in the tube to permit air to be released from the bladder.

8. A method of striking a baseball, comprising the steps of donning a glove according to claim 1 on the hand which is to be furthest from the butt of the bat, grasping the bat with the hands so said ridge abuts the handle of the bat parallel to and beside the finger side of said ridge, and swinging the bat into contact with a baseball.

* * * * *